United States Patent [19]

Wakeman

[11] Patent Number: 4,705,297

[45] Date of Patent: Nov. 10, 1987

[54] BUSINESS FORM ASSEMBLY WITH LEADERS

[75] Inventor: William R. Wakeman, Ransomville, N.Y.

[73] Assignee: Moore Business Forms, Inc., Grand Island, N.Y.

[21] Appl. No.: 822,157

[22] Filed: Jan. 24, 1986

[51] Int. Cl.[4] ..... B42D 1/00; B42D 19/00; B41L 1/20; B65D 27/10

[52] U.S. Cl. ..... 281/2; 281/5; 282/11.5 A; 229/69

[58] Field of Search ..... 281/2, 8, 9, 11, 12, 281/5; 282/14, 3 R, 4, 5, 7, 11.5 A, 11.5 R; 229/69

[56] References Cited

U.S. PATENT DOCUMENTS

| | | | |
|---|---|---|---|
| 2,235,197 | 3/1941 | Brenn | 282/11.5 A |
| 2,319,165 | 5/1943 | Sornberger | 282/11.5 A |
| 2,366,744 | 1/1945 | Metzner | 282/11.5 A |
| 2,931,666 | 4/1960 | Bergmer | 229/69 |
| 3,081,110 | 3/1963 | Drescher | 282/11.5 A |
| 3,993,814 | 11/1976 | Cavender | 281/5 |
| 4,070,223 | 1/1978 | Stalzer | 229/69 |
| 4,091,987 | 5/1978 | Cone | 282/11.5 A |
| 4,123,086 | 10/1978 | French | 282/11.5 A |
| 4,166,643 | 9/1979 | Fischlin | 282/11.5 A |
| 4,342,472 | 8/1982 | Heiman et al. | 282/11.5 A |
| 4,529,227 | 7/1985 | Fields | 281/2 |
| 4,568,108 | 2/1986 | Simpson | 281/2 |

*Primary Examiner*—E. R. Kazenske
*Assistant Examiner*—Paul M. Heyrana, Sr.
*Attorney, Agent, or Firm*—Allegretti, Newitt, Witcoff & McAndrews, Ltd.

[57] ABSTRACT

A continuous business form assembly comprises, first, a longitudinally continuously extending carrier web. The carrier web has a longitudinally spaced series of carrier form stubs thereon. The assembly comprises, second, a longitudinally spaced series of form sets attached to the carrier form stubs. The carrier web further includes spacer sheets alternating with the carrier form stubs. The spacer sheets provide leaders for printer feed tractors, for small quantity computer printer users.

4 Claims, 3 Drawing Figures

BUSINESS FORM ASSEMBLY WITH LEADERS

BACKGROUND OF THE INVENTION

This invention relates to continuous business form assemblies adapted to be fed into automatic printers.

With the advent of small computers, continuous business form assemblies are often fed through printers where printing is computerized although the printing and feeding of forms is intermittent and small in quantity. Small quantity computer users require an efficient method of feeding single form sets into such printers without wasting form sets as leaders for the tractors of such printers.

SUMMARY OF THE INVENTION

A principal object of the present invention is to satisfy the requirements of small quantity computer users for an efficient method of feeding single form sets into computerized printers without wasting form sets as leaders for tractors.

In a principal aspect, the invention is a continuous business form assembly comprising a carrier web and a series of form sets. Both the carrier web and the series of form sets are longitudinally extending. The carrier web is continuous in this longitudinally direction. The carrier web includes a longitudinally extending series of form stubs. The form sets are attached to the form stubs. The carrier web further includes a series of spacer sheets which alternate with the form stubs and provide leaders between the form sets for the printer tractors.

BRIEF DESCRIPTION OF THE DRAWING

The preferred embodiments of the invention will be described in relation to the accompanying drawing. The drawing consists of three figures. The three figures are briefly described as follows.

Figure 1:
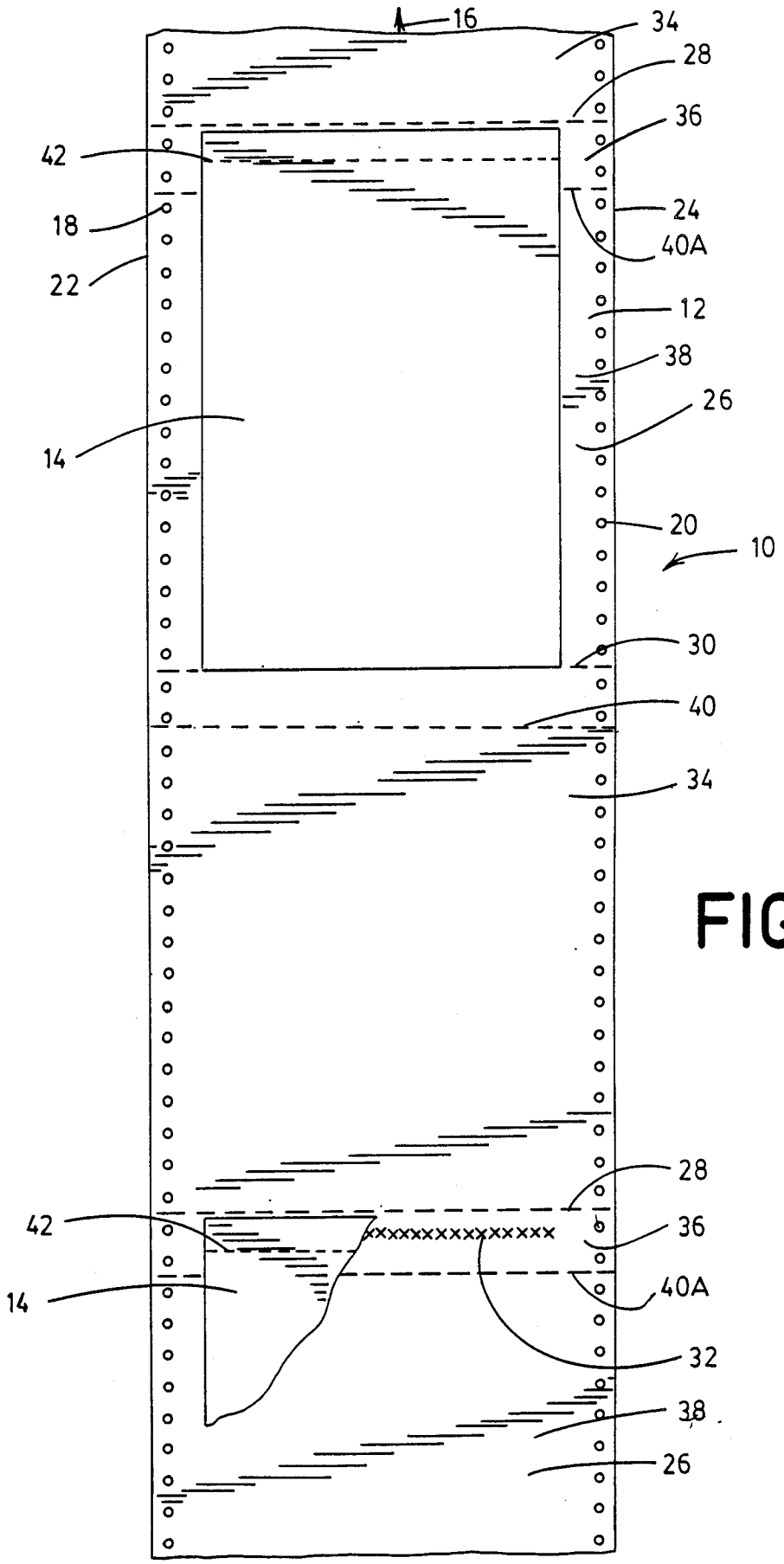
FIG. 1 is a plan view of a first preferred embodiment of the invention.
Figure 2:
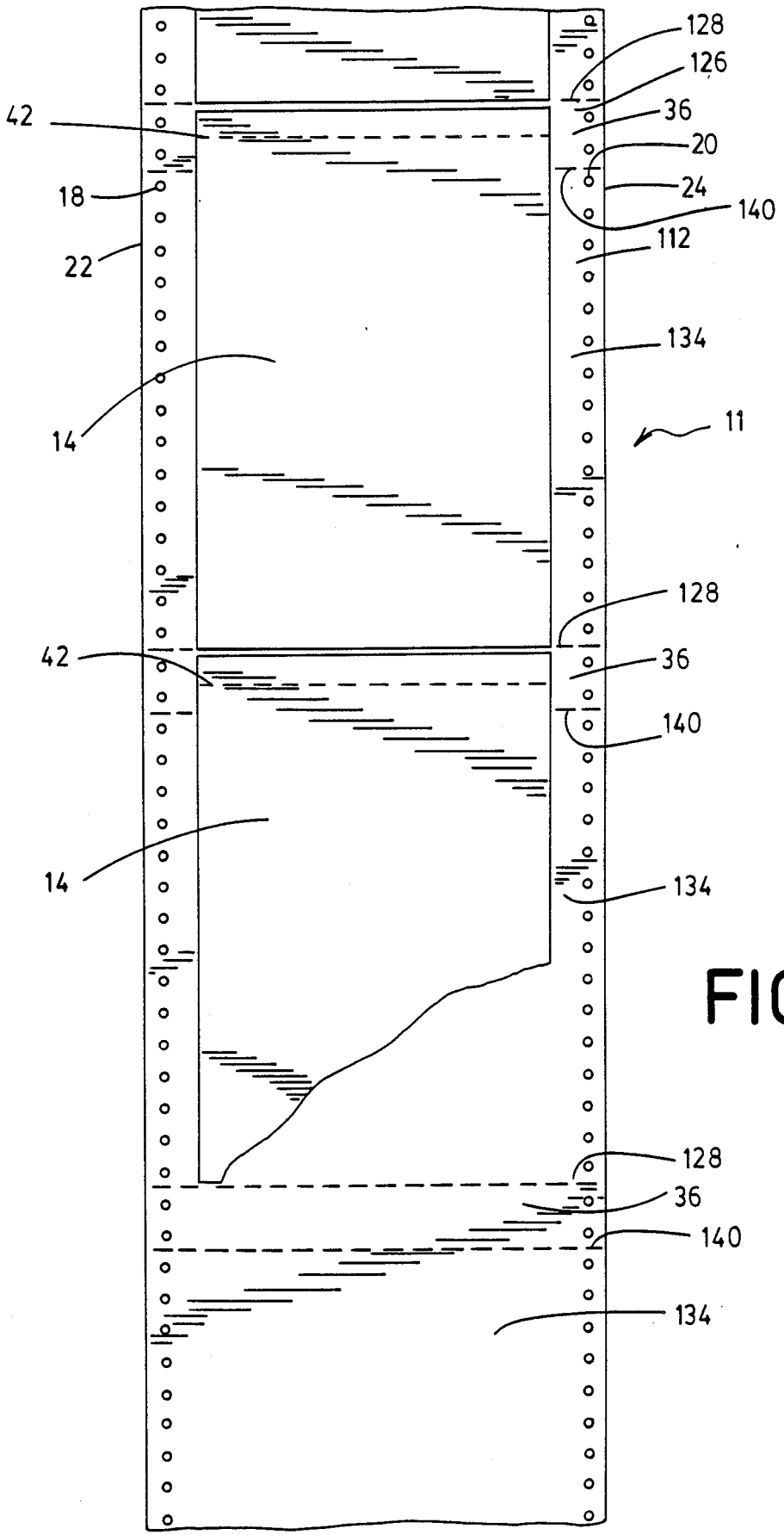
FIG. 2 is a plan view of a second preferred embodiment of the invention.
Figure 3:
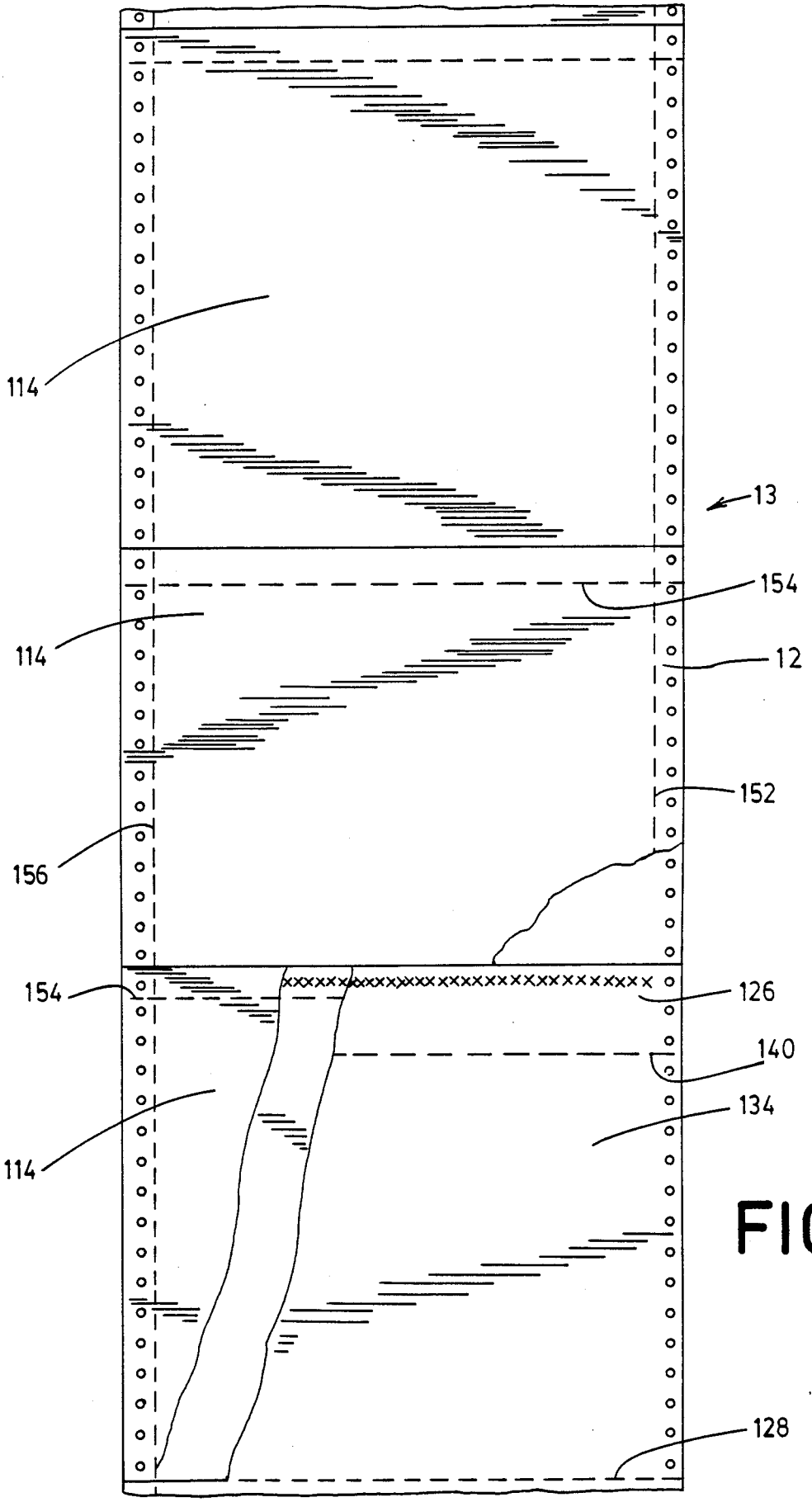
FIG. 3 is a plan view of a third preferred embodiment of the invention.

In all FIGS. 1-3, overlying sheets of the embodiments are partially cut away to reveal underlying detail.

DETAILED DESCRIPTION OF THE PREFERRED EMBODIMENTS

Referring to FIG. 1, the first preferred embodiment 10 of the present invention includes a carrier web 12 and a series of form sets 14. The carrier web 12 is continuous in a longitudinal direction 16. The carrier web 12 includes two longitudinally extending series of tractor feed holes 18, 20 along the margins 22, 24, respectively, of the web 12. In this first preferred embodiment, the web 12 includes a longitudinally extending series of spaced form stubs 26. Each form stub 26 extends between a first transversely extending fold perforation line 28 and a second transversely extending fold perforation line 30. As apparent, the fold perforation lines 28 constitute a first series of spaced fold perforation lines 28 and the fold perforation lines 30 constitute a second series of spaced perforation lines 30.

Each form set 14 comprises such a number of sheets as desired. For purposes of illustration, form sets 14 as shown comprise one sheet each. Each form set 14 is attached to a form stub 26 by fastening means such as a glue line 32 along a fold perforation line 28. Glue lines 32 constitute a longitudinally spaced series of fastening means. In this embodiment, the form sets 14 include tear-off perforation lines 42 that are substantially parallel to fold perforation lines 28 such that glue lines 32 are located between the tear-off perforation lines 42 and fold perforation lines 28.

The carrier web 12 further includes a longitudinally spaced series of spacer sheets 34. Each spacer sheet 34 extends between two form stubs 26 and more specifically, between a fold perforation line 30 and the next fold perforation line 28. Each spacer sheet 34 includes a tear-off perforation line 40, and each form stub 26 includes a tear-off perforation line 40A. To facilitate manufacture of the business form assembly, both sets of tear-off perforation lines 40 and 40A should desirably be provided. However, tear-off perforation lines 40A may be omitted if desired. In an alternate embodiment, fold perforation line 30 and tear-off perforation line 40 or 40A may comprise a single tear-off line 40 or 40A.

Each form stub 26 includes a stub portion 36 and a backing sheet 38. Each stub portion 36 extends between a fold perforation line 28 adjacent a spacer sheet 34 to a tear-off perforation line 40A adjacent a backing sheet 38. Each backing sheet 38 extends from a tear-off perforation line 40A to fold perforation line 30.

The form sets 14 overlie the form stubs 26, and more specifically, both the stub portion 36 and the backing sheet 38 thereof. The stub portion 36 is shorter than the backing sheet 38. Each spacer sheet 34 is without overlying structure, and provides a leader for feed tractors.

Referring to FIG. 2, like structure is identified with like numerals in this second preferred embodiment 11. While the embodiment 11 includes form sets 14 as in FIG. 1, the carrier web 112 includes form stubs 126 comprised solely of stub portions 36. The spacer sheets 134 extend between the stub portions 36, and more specifically, between tear-off perforation line 140 and fold perforation line 128. Thus, in contrast to the first embodiment 10, the second preferred embodiment 11 includes spacer sheets 134 which are overlaid in part by the form sets 14. The form stubs are shorter than the spacer sheets 134. Removal of a printed form set 14 is by perforation along a tear-off perforation line 42, leaving the spacer sheet 134 as a leader for feed tractors, as with embodiment 10.

Referring to FIG. 3, the third preferred embodiment 13 comprises a carrier web 12 as in FIG. 1, with spacer sheets 134 and form stubs 126. The form sets 114 differ from the form sets 14 in that the form sets 114 extend from margin to margin of the carrier web 12. Removal of a printed form set 114 occurs through perforation of a transverse tear-off perforation line 140 and subsequent perforation along tear-off perforation lines 152, 154 and 156 as desired. As with the second perferred embodiment, such perforation leaves a spacer sheet 134 as a leader for feed tractors.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A continuous business form assembly comprising:
   a longitudinally continuously extending carrier web having a longitudinally extending series of carrier form stubs; and a longitudinally extending series of form sets attached to the form stubs by fastening means;

a longitudinally extending series of spacer sheets alternating with the form stubs;

each form stub extending between a first transversely extending fold perforation line and a second transversely extending fold perforation line;

each form set having a first tear-off perforation line substantially parallel to the first transversely extending fold perforation line;

the fastening means located between the first tear-off perforation line and the first transversely extending fold perforation line;

each spacer sheet extending between the second transversely extending fold perforation line and the first transversely extending fold perforation line of a following form stub;

each form stub conforming a stub portion and a backing sheet;

each stub portion extending between the first transversely extending fold perforation line and a second tear-off perforation line;

the stub portion being shorter than the backing sheet.

2. A continuous business form assembly as in claim 1 in which a form set is attached to each of the form stubs.

3. A continuous business form assembly as in claim 1 in which each form set includes longitudinal ends, in which each form set overlies only said backing sheet and said stub portion with each form set attached to a stub portion, the spacer sheets extending between the ends of the form sets.

4. A continuous business form assembly as in claim 1 in which each form set extends from margin to margin of the carrier web.

* * * * *